United States Patent [19]

Bikker

[11] 4,417,724

[45] Nov. 29, 1983

[54] BRAKE ASSEMBLIES PRIMARILY FOR EXERCISING APPARATUS

[75] Inventor: Anthony Bikker, West Midlands, England

[73] Assignee: Welltron Limited, West Midlands, England

[21] Appl. No.: 189,233

[22] Filed: Sep. 22, 1980

[30] Foreign Application Priority Data

Sep. 22, 1979 [GB] United Kingdom ..... 7932949

[51] Int. Cl.[3] ..... A63B 21/22

[52] U.S. Cl. ..... 272/73; 188/251 A; 272/DIG. 4

[58] Field of Search ..... 272/73, 132, DIG. 3, 272/DIG. 4, 131; 188/83, 75, 251 A; 308/23.5, 23, 74, 238, DIG. 7

[56] References Cited

U.S. PATENT DOCUMENTS

| | | | |
|---|---|---|---|
| 538,722 | 5/1895 | Biedermann | 188/75 X |
| 943,790 | 12/1909 | Rosholt | 308/23 |
| 2,073,626 | 3/1937 | De Filippis | 188/75 X |
| 2,673,088 | 3/1954 | Wentz | 272/73 |
| 2,985,494 | 5/1961 | Terhorst | 308/74 X |
| 3,601,395 | 8/1971 | Morgan | 272/73 |
| 3,622,153 | 11/1971 | Thompson | 272/73 |
| 4,083,580 | 4/1978 | Shaner | 308/74 X |

FOREIGN PATENT DOCUMENTS

| | | | |
|---|---|---|---|
| 143992 | 4/1948 | Australia . | |
| 507755 | 2/1980 | Australia . | |
| 753410 | 8/1933 | France | 188/251 A |
| 448351 | 6/1936 | United Kingdom | 188/251 A |
| 616982 | 1/1949 | United Kingdom | 188/251 A |
| 726381 | 3/1955 | United Kingdom | 188/251 A |
| 1143992 | 2/1969 | United Kingdom | 188/251 A |
| 1495779 | 12/1977 | United Kingdom . | |
| 1521473 | 8/1978 | United Kingdom | 272/73 |

*Primary Examiner*—Robert A. Hafer
*Assistant Examiner*—Arnold W. Kramer
*Attorney, Agent, or Firm*—Hamrick, Hoffman & Guillot

[57] ABSTRACT

A brake assembly comprising a spindle, two components having concave part-cylindrical bearing faces embracing a cylindrical portion of the spindle, and a housing accommodating the components and carrying an adjuster for urging the bearing faces of the components into engagement with the surface of said portion of the spindle. The bearing face of each component either comprises a single material or surface portions of different materials having relatively high and relatively low coefficients of friction so that when the bearing faces of the components are urged into engagement with the spindle they provide resistance to turning of the spindle while at the same time providing a low friction bearing for the spindle. The assembly may be incorporated in an exercising apparatus comprising a frame, a seat and a handlebar, the assembly being supported by the frame and the spindle carrying pedals to be turned by a user to rotate the spindle against resistance to turning of the spindle.

4 Claims, 3 Drawing Figures

BRAKE ASSEMBLIES PRIMARILY FOR EXERCISING APPARATUS

BACKGROUND OF THE INVENTION

Field of the Invention

This invention relates to brake assemblies of the kind (hereinafter referred to as of the kind specified) comprising a spindle which is rotatable in bearing means and has braking means operable to apply resistance to turning of the spindle.

The invention has many applications but has been devised primarily for use in an exercising apparatus for exercising a person's legs or arms and of the kind (hereinafter referred to as the kind set forth) incorporating a brake assembly of the kind specified and comprising rotary means turnable by a person's legs or arms to rotate the spindle of the brake assembly whereby the legs or arms are exercised by the effort required to turn the spindle against resistance to such turning applied by the braking means.

More particularly, in this regard, the invention is applicable to an exercising apparatus of the type (hereinafter referred to as the type specified) for exercising the legs in the manner of a bicycle and comprising a frame for supporting the apparatus on the ground and carrying a seat for a user, a handlebar to be gripped by the user's hands and two pedals to be acted upon by the user's feet to rotate a spindle of a brake assembly of the kind specified incorporated in the apparatus.

Although the following description of the invention is directed mainly to an exercising apparatus, it is to be understood that there is no limitation in this regard since the brake assembly provided by the invention can be used in other applications.

SUMMARY OF THE INVENTION

According to a first aspect of the present invention there is provided a brake assembly of the kind specified wherein the bearing means comprises at least two components having concave part-cylindrical bearing faces arranged to embrace a cylindrical portion of the spindle, and the braking means comprises means for urging the bearing faces of the components into engagement with the surface of said portion of the spindle, the spindle being supported solely by the said components and the bearing faces of the latter being formed to provide resistance to turning of the spindle when urged into engagement with the surface of said portion of the spindle whilst at the same time providing a low friction bearing for the spindle.

The braking means and the bearing means are therefore combined and this enables the brake assembly to be made very compact. Moreover, it is not necessary to use expensive bearings such as needle bearings as the bearing means.

The bearing face of at least one of the components may comprise at least two surface portions of different materials having respectively a relatively low coefficient of friction and a relatively high coefficient of friction, whereby when the component is urged into engagement with the spindle the frictional engagement of the high coefficient of friction surface portion of the component with the spindle provides resistance to turning of the spindle whilst the engagement of the low coefficient of friction surface portion of the component with the spindle provides a low friction bearing for the spindle.

Alternatively, the bearing face of at least one of the components may comprise a single material such as to provide both resistance to turning of the spindle and a bearing for the spindle.

According to a second aspect of the invention, there is provided an exercising apparatus of the kind set forth which incorporates a brake assembly according to the first aspect. The apparatus is preferably of the type specified.

BRIEF DESCRIPTION OF THE DRAWINGS

The invention will now be described by way of example, with reference to the accompanying drawings, in which.

DESCRIPTION OF THE PREFERRED EMBODIMENT

Figure 1:
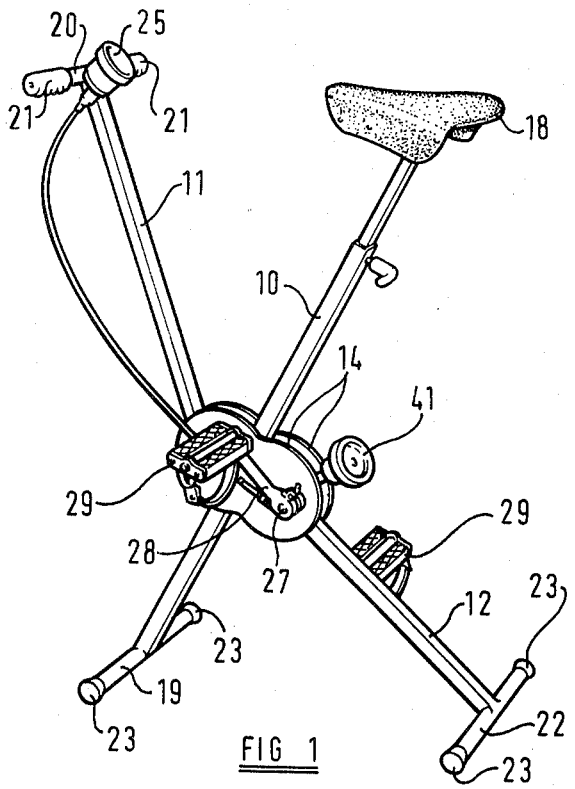
FIG. 1 is a perspective view of an exercising apparatus incorporating one form of brake assembly embodying the invention.
Figure 3:
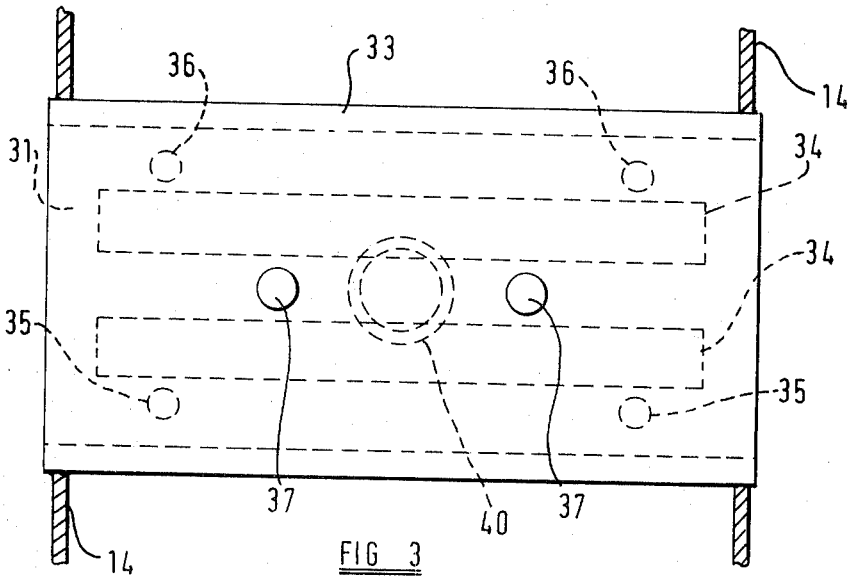
FIG. 3 is a partial section taken in the direction of arrow A in FIG. 2.

The exercising apparatus illustrated in the drawings has a frame constituted by a first member 10, a second member 11 and a third member 12. These members each consist of a length of rigid square section metal tubing, and the member 10 is longer than each of the members 11 and 12.

Figure 2:
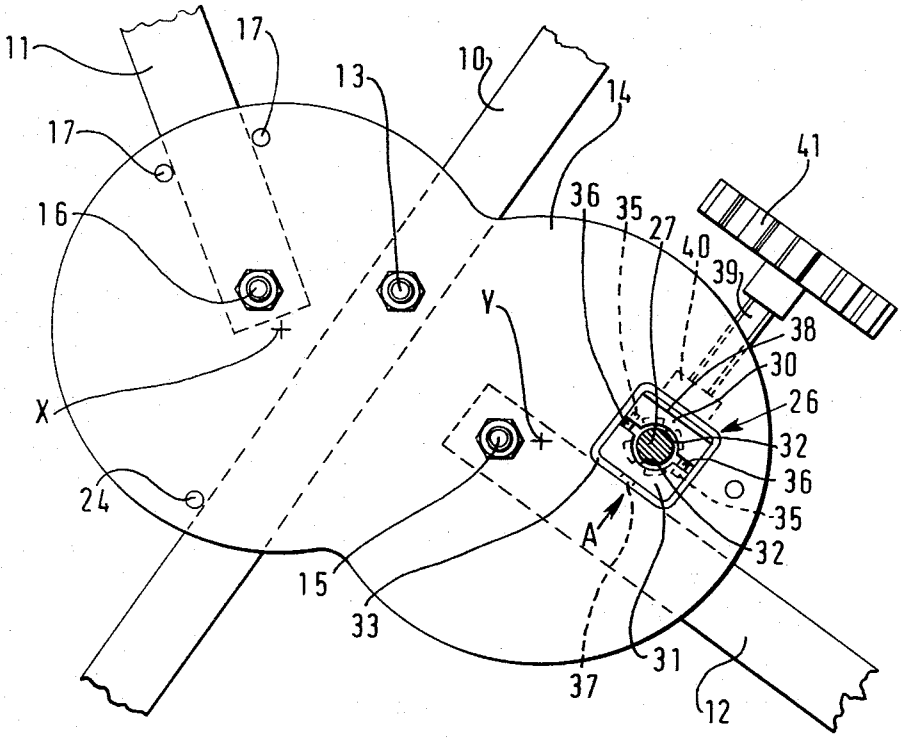
FIG. 2 is a side view of the support of the exercising apparatus which carries the brake assembly.

The first member 10 is pivotally connected by means of a nut and bolt 13 (FIG. 2) passing through it at a location intermediate its ends to a support which comprises two spaced parallel plates 14 extending on opposite sides of the member. The third member 12 is also pivotally connected at one, upper end thereof to the support plates 14 by means of a nut and bolt 15. The second member 11 is rigidly fixed at one, lower end thereof to the support plates 14 by means of a nut and bolt 16 and two pins 17 abut opposite sides of the member to prevent it turning about the bolt 16.

The plates are identical and each comprises two part-circular parts having their centres of curvature at X and Y.

The member 10 carries at its upper end a seat 18 in the form of a bicycle saddle and has at its lower end a ground-engaging foot 19. The member 11 carries at its upper end a handlebar 20 provided with hand grips 21 of rubber or plastics and the member 12 has a ground-engaging foot 22 at its lower end. The feet 19, 22 and the handlebar 20 are each constituted by a length of circular section tubing welded to the end of the relevant member and extending transversely of the latter. End pieces 23 of rubber or plastics are fitted on the ends of the feet 19, 22.

The frame is shown in FIG. 1 in its erected condition in which the members thereof are disposed generally in an X-configuration. The frame is collapsible into a compact form for transport or storage, the member 10 being pivoted relative to the member 11 about its pivot 13 to bring its upper part above the support plates 14 into substantially parallel close relationship with the member 11, and the member 12 being pivoted about its pivot 15 into a position in which it lies substantially parallel and close to the lower part of the member 10.

The extent of relative movement of the members on erection of the frame is limited by stops comprising a pin 24 which is secured to the support plates 14 and is arranged to be engaged by the member 10, and the housing of the brake assembly (see below) which is carried by the support plates 14 and is arranged to be engaged by the member 12.

It will be seen that the angle between the member 12 and the lower part of the member 10 below the support plates 14 is greater than the angle between the member 11 and the upper part of the member 10, and the support is disposed at a relatively low position, i.e. the vertical distance between the support and the ground is less than the vertical distance between the support and the level of the seat 18 and the handlebar 20.

The height of the seat is adjustable and the handlebar carries a speed and distance indicator 25.

The support plates 14 carry a brake assembly 26 including a spindle 27 which projects from opposite sides of the support and has secured to its respective ends two cranks 28 carrying pedals 29. The pedals are provided with straps for holding a user's feet on them.

The brake assembly also comprises two identical components 30 and 31, each of which is of rectangular shape in both cross-section and longitudinal section and is provided with a longitudinally extending bearing face 32. The components are arranged with their bearing faces embracing a cylindrical portion of the spindle 27 intermediate its ends and are accomodated in a square section hollow housing 33, the ends of which are a close fit in complementary apertures in the support plates 14.

Each component 30, 31 comprises a body moulded of a suitable plastics material, preferably Nylon, having a relatively low coefficient of friction, and two elongate elements 34 of generally rectangular cross-section and of a material having a relatively high coefficient of friction, preferably that sold under the Trade Mark FERODO, the elements being moulded integrally with the body so that each has a side face thereof flush with the bearing face 32 of the component and providing a part-cylindrical friction face. The body may be injection moulded, the elements being located in the mould by means of pins.

The plastics body of each component 30, 31 may be reinforced by chopped glass fibres or carbon fibres, particulary to prevent distortion thereof.

The spindle 27 is of metal, preferably EN10 hard durable steel which has not been heat treated.

The two faces of each component 30, 31 at opposite sides of its bearing face 32 are formed with two holes 35 and two pins 36 respectively. The pins of each component are received in the holes of the other component to locate the two components axially relative to one another. Each component is also formed with two projections 37. The projections of component 31 are received in holes in the housing 33 to locate the component in the housing and the projections of component 30 are received in holes in a pressure plate 38 acted upon by the inner end of a screw-threaded stem 39 which is engaged in a screw-threaded hollow boss 40 secured to, and projecting from, the housing, the stem extending through an aperture in the housing and carrying an adjusting knob 41 at its outer end.

The housing 33 is held rigid with the support 14 when the apparatus is in use since the weight of the user urges the member 12 into engagement with the housing.

The component 30 acted upon by the adjusting screw 39 is movable towards the other component 31 by turning of the screw. The screw acts through the pressure plate 38 to press the bearing face of the component 30 into engagement with the spindle 27 and as a result the spindle is pressed into engagement with the bearing face of the component 31. The engagement with the spindle of the surface portions of the bearing faces of the two components which are provided by the plastics bodies provides a low friction bearing for the spindle and the engagement with the spindle of the surface portions provided by the elements 34 provides resistance to turning of the spindle by the pedals. The pressure plate applies pressure evenly along the whole length and across the whole width of the component 30. The screw 39 is adjustable to vary the braking effect and hence the amount of such resistance according to the user's requirements.

The brake assembly is compact and as a result can be positioned towards the rear of the apparatus in such a position relative to the seat that there is less resistance to turning of the pedals at their top dead centre positions. The assembly produces an even, sticky action on turning of the pedals, and only a small movement of the adjusting screw is necessary to vary the braking effect. The screw is conveniently accessible to the user.

In an alternative embodiment the components may be externally part-cylindrical in shape.

In a modification of the apparatus, the friction elements 34 are omitted from the components 30, 31, the latter in this case being of polyurethane. Thus, each component merely comprises a body moulded of polyurethane which preferably has a shore hardness of about 50. This material has the characteristic that it has a relatively low coefficient of friction at normal temperatures but a higher coefficient of friction when it becomes warm. Thus, with the adjusting screw set so that only a small amount of pressure is applied to the component 30 by the pressure plate 38, there is little friction between the spindle 27 and the two components 30, 31 on turning of the spindle and therefore little heat is generated. As a result, the components retain their relatively low coefficient of friction and the resistance of turning of the spindle does not increase. However, when the screw is adjusted to increase the pressure applied by the pressure plate to the component 30, the friction between the spindle and the two components increases and the components become warm. As a result, their coefficient of friction increases and they provide a greater resistance to turning of the spindle.

What is claimed is:

1. An exercising apparatus comprising a frame, rotary means turnable by a person's legs or arms to rotate a spindle, bearing means for supporting the spindle for rotation on the frame and braking means operable to apply resistance to turning of the spindle, wherein the bearing means comprise two components which have concave part-cylindrical bearing faces engaging a cylindrical portion of the spindle at diametrically opposed locations and are relatively movable towards and away from one another along a line passing through said locations and the axis of the spindle, the spindle being supported soley by the two components, wherein the two components are mounted in a housing which is fixed to the frame and carries the braking means, one component is acted upon by the braking means at a location lying on said line to apply a force to said one component in a direction along the line to move the component relative to the housing towards the other component to urge the bearing faces of the two components into engagement with the spindle, the bearing faces of the components being formed to provide resistance to turning of the spindle when urged into engagement with said portion thereof whilst at the same time providing a bearing for the spindle and said other component having projections received in holes in the housing to locate the component with respect to the housing.

2. An exercising apparatus as claimed in claim 1 wherein the housing is of rectangular cross-section and the spindle extends longitudinally thereof, and the components are of rectangular cross-section to fit in the rectangular section housing with their part-cylindrical bearing faces extending longitudinally thereof.

3. An exercising apparatus as claimed in claim 1 or claim 2 wherein the braking means comprise a screw-threaded stem engaged in a complementarily screw-threaded aperture in the housing and arranged to act on said one component, the screw being adjustable to vary the braking force.

4. An exercising apparatus as claimed in claim 3 wherein the screw-threaded stem acts on said one component through the medium of a pressure plate extending the full width and length of the component.

* * * * *